United States Patent [19]

Umeda et al.

[11] Patent Number: 4,691,499

[45] Date of Patent: Sep. 8, 1987

[54] METHOD OF TENSIONING A WEB OF PACKAGING MATERIAL

[75] Inventors: Yoshiaki Umeda; Ryouhei Matsumoto; Hiroyasu Isomura; Hisakuni Shimotaka, all of Aichi, Japan

[73] Assignee: Fuji Machinery Company, Ltd., Aichi, Japan

[21] Appl. No.: 666,676

[22] Filed: Oct. 31, 1984

[30] Foreign Application Priority Data

Apr. 16, 1984 [JP] Japan ..... 59-77010
Apr. 16, 1984 [JP] Japan ..... 59-77013

[51] Int. Cl.[4] ..... B65B 9/06; B65B 41/12; B65B 41/16

[52] U.S. Cl. ..... 53/451; 53/52; 53/551; 53/389; 242/67.5; 242/75.45

[58] Field of Search ..... 53/551, 552, 554, 389, 53/451, 52; 242/67.5, 75.45; 74/844

[56] References Cited

U.S. PATENT DOCUMENTS 3,727,856 4/1973 Kitch ..... 242/75.45
3,901,002 8/1975 Vetter ..... 53/389
3,979,080 9/1976 Herbert et al. ..... 242/75.45 X
4,278,213 7/1981 Rubruck ..... 242/67.5 X
4,288,965 9/1981 James ..... 53/551 X
4,501,109 2/1985 Monsees ..... 53/389 X

*Primary Examiner*—Horace M. Culver
*Attorney, Agent, or Firm*—Schwartz & Weinrieb

[57] ABSTRACT

Disclosed herein is a method of tensioning a web packaging material in a form-fill-seal packaging apparatus wherein the web is pulled from a supply roll through web feeding rolls, guided over means for forming it into tubing and fed toward means for feeding the tubing forward, and wherein articles to be packaged are provided in the tubing and sealing operations are performed on the tubing to seal it to form packages. The invention method is characterized in that the web feeding rolls and the tubing feeding means are concurrently started, and when the web feeding rolls and the tubing feeding means are stopped to form a seal on the tubing, the tubing feeding means is stopped slightly later than the web feeding rolls so that the web forward by the web feeding rolls is taken up and pulled toward the tubing feeding means under tension. Another method is disclosed for tensioning a web between the supply roll and the web feeding rolls, wherein a suitable braking is applied to the rotating supply roll so that the web fed forward by the feeding rolls is taken up under tension.

20 Claims, 10 Drawing Figures

METHOD OF TENSIONING A WEB OF PACKAGING MATERIAL

FIELD OF THE INVENTION

This invention relates generally to a method of tensioning a web, and more particularly relates to a method of tensioning a web of packaging material in a form-fill-seal packaging machine commonly referred to as a "vertical packaging machine" or as a "horizontal packaging machine" in which a web of packaging material is fed from a supply roll, formed into tubing, intermittently stopped, and sealed at package length intervals. The invention is especially concerned with a method of suitably tensioning a web of packaging material for the purpose of preventing slack of the web which will be developed between web feeding rolls and tubing feeding means when the web is intermittently stopped to be sealed at packages length intervals. The invention is also directed to the prevention of slack which will be developed between the web feeding rolls and the supply roll in the event that the diminishing supply roll is excessively overrun by the web which is intermittently pulled forward through the web feeding rolls.

BACKGROUND OF THE INVENTION

In the first place, a brief description will be given as to how the present invention method has proposed, with reference to FIG. 1 illustrating a so-called vertical packaging apparatus, which is one typical type of form-fill-seal packaging apparatus. In the apparatus illustrated, a web 14 of plastic material such as polyethelene sheet is fed from a supply roll 16 of the material over a former or web forming device 12 mounted on the upper part of a vertically extending cylindrical, hollow mandrel 10. At the former 12 the web 14 is formed into tubing, the tubing being fed downward a predetermined length and sealed by a center sealing device 18 so as to form a longitudinal seal on the edges overlapping in the longitudinal direction and sealed at package length intervals. Articles W are supplied from upstream direction into the tubing. Then the tubing is fed forward a predetermined length, intermittently stopped, sealed by an end sealing device 20 so as to form transverse seals and ultimately cut by a cutter 22 into individual packages filled with articles (FIG. 3). The web 14 is intermittently pulled from the supply roll 16 and fed forward toward the former 12 means of by a pair of web feeding rolls 24 located between the supply roll 16 and the former 12. The feeding rolls 24 are intermittently driven for feeding the web 14 forward one package length increment in a given time interval.

The increment of the web 14 fed forward by the web feeding rolls 24 is taken up and pulled over the former 12 under tension by tubing feeding means indicated generally at 26 in FIGS. 1 and 3 below the former 12. The tubing feeding means 26, as illustrated in FIG. 2, comprises a pair of endless belts each designated 30 and disposed on opposite sides of the mandrel 10. Each of belts 30 is trained around a pair of pulleys 28 arranged in vertical alignment at the respective side of the mandrel 10. The belts 30 are rotated in a predetermined direction for feeding the web 14 downwardly so as to be formed into tubing at the former 12 and thence gripped in sealing engagement with the outer periphery of the mandrel 10. In FIG. 1, reference numeral 31 designates a register mark sensor for sensing register marks printed on the web 14. Reference numerals 33 and 35 designate a guide plate and turning bars, respectively.

In the operation of form-fill-seal packaging machines of the type just described, the web 14 may slacken betweeen the web feeding rolls 24 and the tubing feeding means 26, and tends to meander when fed forward toward the former 12. Because of such unsmooth feeding of the web 14, therefore, the machine may have to be operated at a lower package production rate than desired. Additionally, the web feeding rolls 24 intermittently pull a package length increment of the web 14 from the supply roll 16, thereby diminishing the diameter and hence the mass of the supply roll 16 with the passage of time. Thus the resulting augmented pull tends to excessively overrun the supply roll 16, causing the web 14 to slacken in the path from the supply roll 16 to the web feeding rolls 24. Again, because of such slack, the web 14 may not be fed forward smoothly, reducing the efficiency of the operation.

OBJECTS OF THE INVENTION

It is, accordingly, an object of the present invention to eliminate the above disadvantages found in the operation of a form-fill-seal packaging apparatus.

It is another object of the present invention to maintain suitable tension over a web of packaging material interposed between the web feeding rolls and the tubing feeding means by preventing slack from developing when the web is intermittently stopped to form a transverse seal on the web formed into tubing.

It is a further object of the present invention to prevent possible slack on a web of packaging material disposed in the passage between the supply roll and the web feeding rolls by applying a suitable braking force to the web located in the passage.

SUMMARY OF THE INVENTION

In accordance with the present invention, there is provided a method of tensioning a web of packaging material in a form-fill-seal packaging apparatus wherein the web is pulled from a supply roll through web feeding rolls, guided over means for forming it into tubing and fed toward means for feeding the tubing forward, and wherein articles to be packaged are provided in the tubing and sealing operations are performed on the tubing to seal it to form packages. The invention method is characterized in that the web feeding rolls and the tubing feeding means are concurrently started, and when the web feeding rolls and the tubing feeding means are stopped to form a seal on the tubing, the tubing feeding means is stopped slightly later than the web feeding rolls so that the web fed forward by the web feeding rolls is taken up and pulled toward the tubing feeding means under tension.

Preferably, when the web feeding rolls and the tubing feeding means are controlled to start and stop, the web feeding rolls and the tubing feeding means are concurrently started at low speeds, brought to a steady operation at high speeds, subsequently shifted into a low-speed operation, and ultimately stopped to form a seal on the tubing.

Also, in accordance with the present invention, there is provided a method of tensioning a web of packaging material located between the supply roll and the web feeding rolls, comprising the steps of sensing the diameter of the supply roll which is progressively diminished with the passage of time during which the web is fed forward by the web feeding rolls; comparing by use of a central processing unit the sensed value with values which are previously stored in the central processing unit and which represent the width of the web and the cut pitch corresponding to one desired length for the packages to be formed; processing the comparison value; and applying a suitable braking to the rotating supply roll on the basis of the resulting value, whereby the web fed forward by the web feeding rolls is taken up under tension.

BRIEF DESCRIPTION OF THE DRAWINGS

The invention will now be described by way of example and with reference to the accompanying drawings, in which.

DETAILED DESCRIPTION OF THE INVENTION

Figure 1:
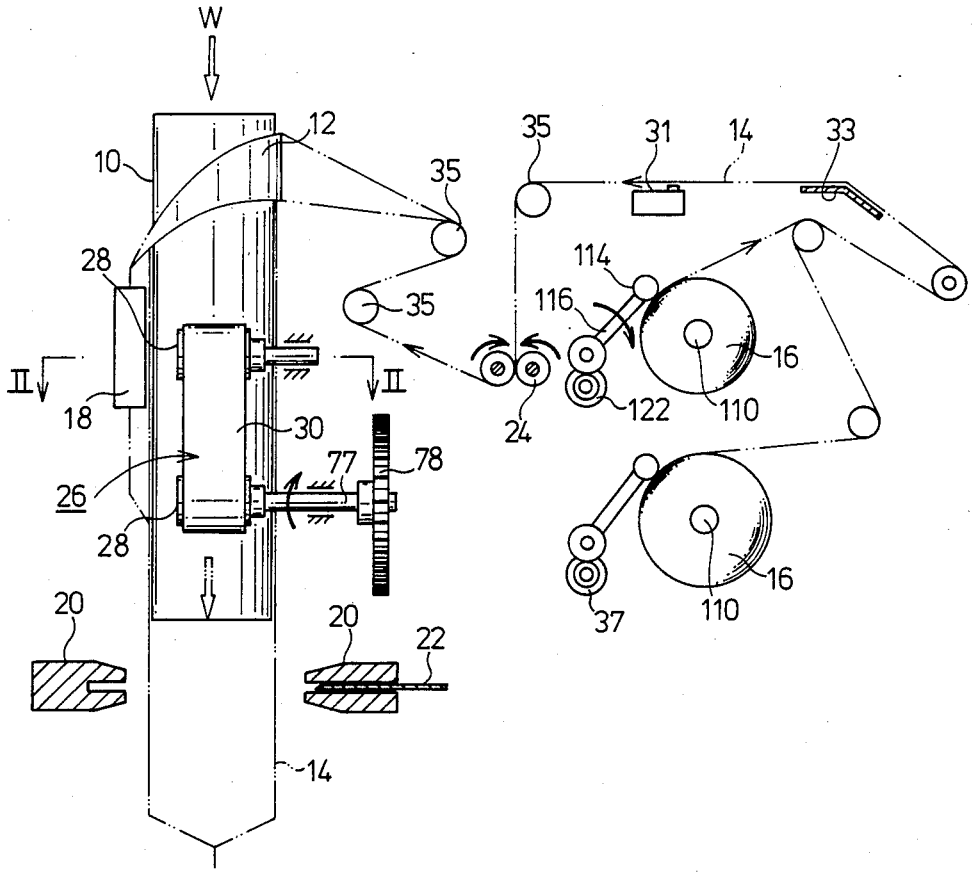
FIG. 1 is a schematic representation of a form-fill -seal packaging apparatus for carrying out the invention method.
Figure 2:
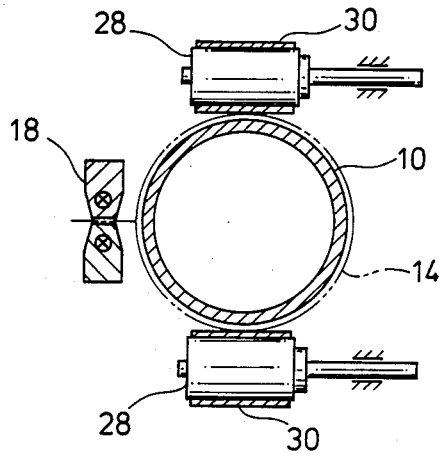
FIG. 2 is a sectional view taken substantially along the line II—II of FIG. 1.
Figure 3:
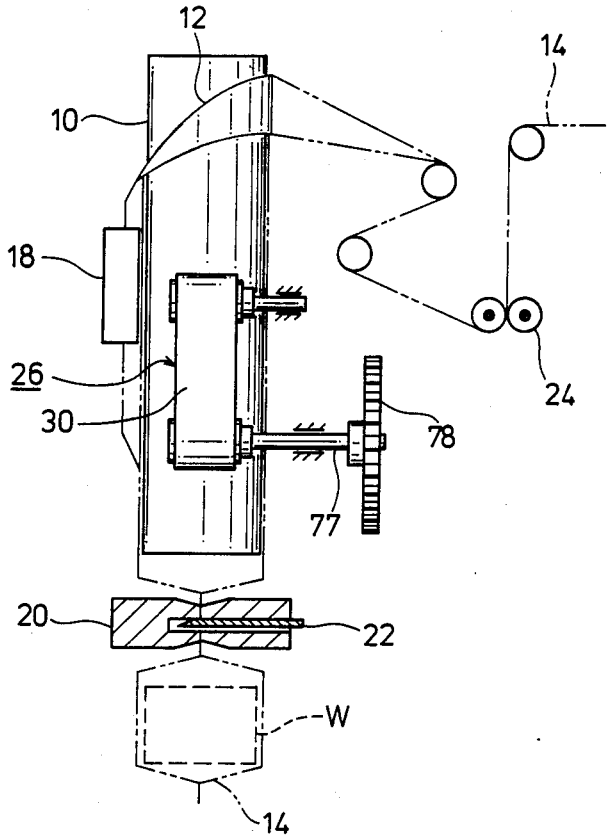
FIG. 3 is a schematic representation of the apparatus of FIG. 1 in which the end sealing device forms a transverse seal on a tubing when the web feeding rolls and the tubing feeding means are stopped.
Figure 5:
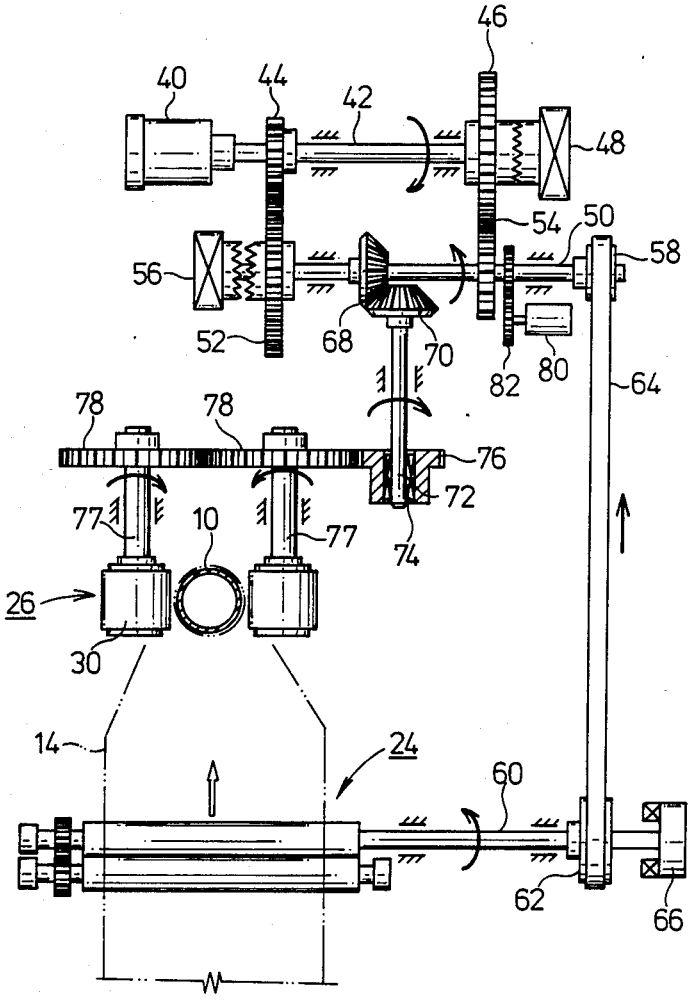
Figure 6:
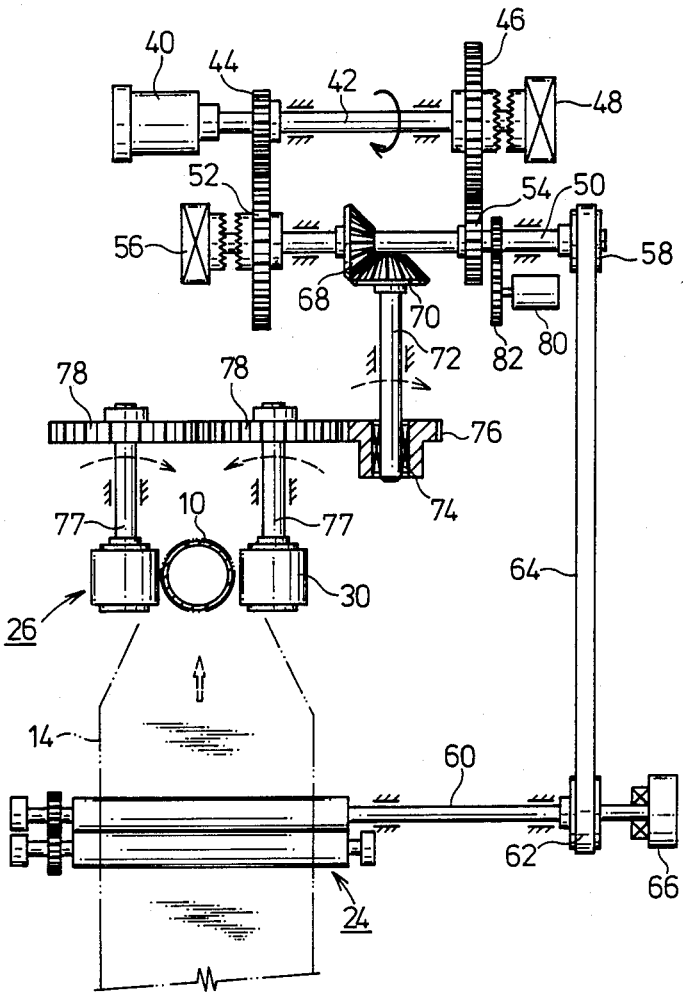

The inventive method of tensioning a web of packaging material will now be described with reference to FIGS. 4 to 6 which illustrate one embodiment of the apparatus for performing the method. For convenience in the describing, all parts are numbered to correspond to similar parts of FIGS. 1 to 3, and the general description of the parts of FIGS. 4 to 6 is applicable to the corresponding parts of FIGS. 1 to 3.

Figure 4:
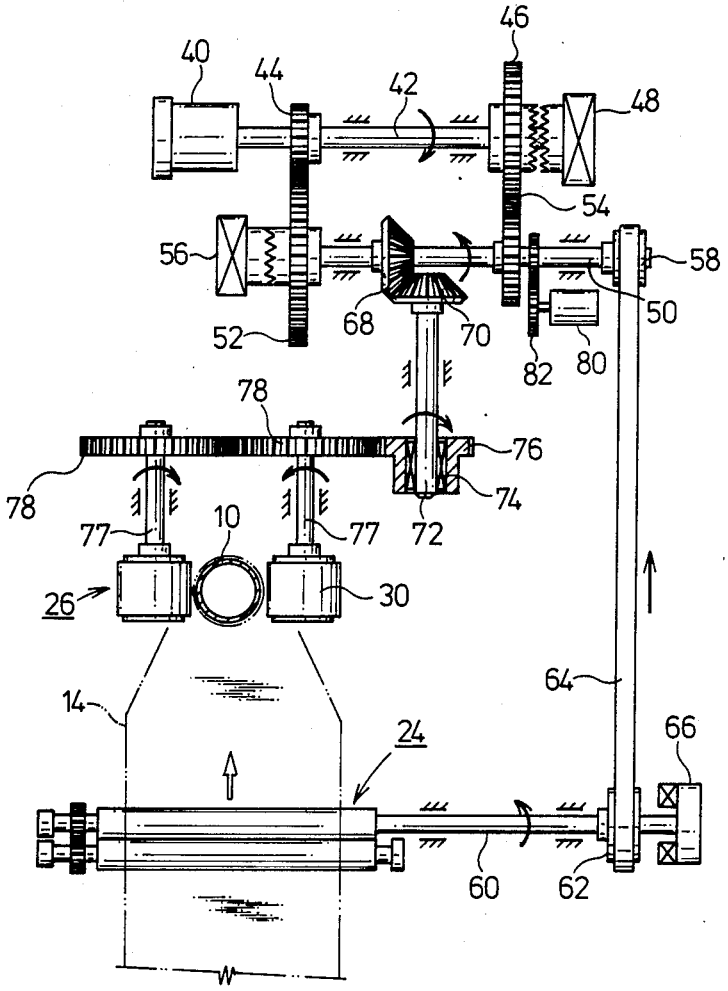
FIGS. 4 to 6 are schematic representations of the overall arrangement of the apparatus for performing the invention method, showing the transmission and disconnection of rotational force in various phases of operation through the apparatus.

Referring first more particularly to FIG. 4, there is generally indicated at 40 a motor which is a common single source of drive adapted to rotate and stop the web feeding rolls 24 and the tubing feeding means 26. A first rotary shaft 42 is connected at one end to the motor 40 and has a small-diameter gear 44 secured thereto. The first rotary shaft 42 also has a large-diameter gear 46 secured thereto and spaced a predetermined distance from the small-diameter gear 44. The large-diameter gear 46 is freely rotatably carried on the rotary shaft 42 and is operatively connected to an electromagnetic clutch 48 mounted on the other end of the rotary shaft 42. Thus, on-off control of the electromagnetic clutch 48 permits mechanical connection and release (transmission and cut-off of power) of the large-diameter gear 46 relative to the first rotary shaft 42.

The small-diameter gear 44 normally meshes with another large diameter gear 52 which is freely rotatably carried by a second rotary shaft 50 arranged in parallel relation to the first rotary shaft 42. The second rotary shaft 50 has secured thereto another small-diameter gear 54 which meshes with the large-diameter gear 46 on the first rotary shaft 42. The second rotary shaft 50 has an electromagnetic clutch 56 mounted on one end thereof, and the large-diameter gear 52 is operatively connected to the electromagnetic clutch 56. Thus, on-off control of the clutch 56 permits mechanical connection of the large-diameter gear 52 relative to the second rotary shaft 50. The second rotary shaft 50 has a pulley 58 secured to the other end thereof. Additionally, the web feeding roll 24 has a rotary shaft 60 which in turn has a pulley 62 secured to one end thereof. An endless belt 64 is trained between the pulleys 58 and 62. The rotary shaft 60 also has an electromagnetic brake 66 connected to one end thereof. Thus, actuation of the brake 66 causes the series of gears of the rotational system to stop instantly.

The second rotary shaft 50 has a bevel gear 68 mounted thereon, as shown in FIG. 4. Another bevel gear 70 is secured to a third rotary shaft 72 extending at right angles to the second rotary shaft 50, and meshes with the gear 68. The third rotary shaft 72 has at one end thereof a one-way roll 74 which permits transmission of driving power only in one direction and which freely rotates in the other direction to cut off transmission of driving power. A spur gear 76 is secured to the third rotary shaft 72 through the one-way roll 74. Specifically, in the illustrated embodiment, the third rotary shaft 72 is driven for rotation in a clockwise direction, and the driving power in the clockwise direction causes the third rotary shaft 72 to rotate in the same direction along with the one-way roll 74. It is important to note that when the third rotary shaft 72 is stopped, the spur gear 76 is allowed to rotate in the clockwise direction; and when the third rotary shaft 72 is reversely driven, the spur gear 76 is never allowed to rotate in a counter-clockwise direction.

A pair of spur gears 78 are secured to a pair of rotary shafts 77 which are respectively fixedly connected to one end of the pulleys 28 for driving the feeding belts 30. The spur gears 78, being associated with the respective feeding belts 30 disposed on diametrically opposite sides of the mandrel 10, are connected for meshing engagement with each other, and one of the spur gears 78 is meshed with the spur gear 76 associated with the one-way roll 74. Reference numeral 80 designates a rotary encoder which is connected to the second rotary shaft 50 through means of gear train 82 and is adapted to sense and monitor rotational speeds in the rotational system.

Figure 7:
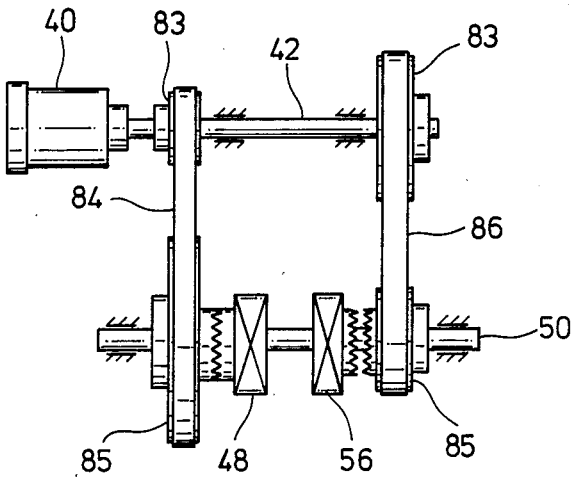
FIGS. 7 and 8 are views showing different arrangements of the shifting means between the high-speed operation and the low-speed operation.
Figure 8:
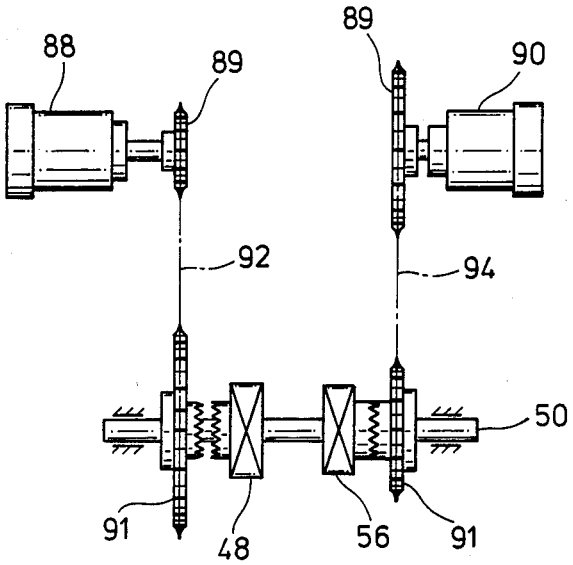

Referring to FIGS. 7 and 8, shown therein is a partially modified embodiment in conjunction with the driving system of FIG. 4. Specifically, FIG. 7 shows an arrangement in which the first electromagnetic clutch 48 and the second electromagnetic clutch 56 are carried on the second rotary shaft 50 of FIG. 4. Power transmission between the first rotary shaft 42 and the second rotary shaft 50 are effected by means of timing pulleys 83,85 and timing belts 84,86. To this end, only one motor 40 is used. FIG. 8 shows another arrangement using two individual driving motors 88,90 in which power is transmitted through sprockets 89,91 and chains 92,94.

The operation and effect of the invention method will now be described. As shown in FIG. 4, to start feeding the web 14 from the supply roll 16, the first electromagnetic clutch 48 is deactuated to thereby allow the large-diameter gear 46 to freely rotate relative to the first rotary shaft 42. The second electromagnetic clutch 56 is actuated to connect the large diameter gear 52 with the second rotary shaft 50. At this time, the electromagnetic brake 66 is deactuated. With these conditions existing, starting rotation of the motor 40 causes the bevel gears 68 and 70 to rotate through the small-diameter gear 44 and the large-diameter gear 52, thereby rotating the third rotary shaft 72 in a clockwise direction. As this occurs, the one-way roll 74 permits the spur gear 76 to rotate in a clockwise direction. The spur gears 78 are then rotated to drive the tubing feeding means 26 and thereby effect downward feed of the web 14 on the mandrel 10. It can be appreciated that since the power transmission is accomplished through the combination of the small-diameter gear 44 and large diameter gear 52, the tubing feeding means 26 is rotated at low speed. Also, it can be seen that the power is transmitted from the second rotary shaft 50, via the belt 64, to the web feeding rolls 24 at low speed. Thus, the web feeding rolls 24 and the tubing feeding means 26 are simultaneously started at low speed to thereby tension the web 14 interposed between the web feeding rolls 24 and the tubing feeding means 26.

When the first electromagnetic clutch 48 is actuated after T1 seconds after starting, as shown in FIG. 5, the large-diameter gear 46 is mechanically connected to the first rotary shaft 42. At the same time as this occurs, the second electromagnetic clutch 56 is deactuated to thereby mechanically disconnect the large-diameter gear 52 from the second rotary shaft 50. Thereupon, the low-speed drive is switched into a high-speed drive, that is, the web feeding rolls 24 and the tubing feeding means 26 are shifted into a steady operation at synchronous high speed. At this time, the web 14 remains tensioned between the web feeding rolls 24 and the tubing feeding means 26.

When a predetermined length of web 14 has been fed forward, it is necessary to stop the forward feed of the web 14 so that a transverse seal may be formed by the end sealing device 20. Specifically, after T2 seconds, the second electromagnetic clutch 56 is actuated and the first electromagnetic clutch 48 is deactuated, as shown in FIG. 4, thereby shifting the web feeding rolls 24 and the tubing feeding means 26 into a low-speed operation. Again, the web 14 remains suitably tensioned between the web feeding rolls 24 and the tubing feeding means.

Further, after T3 seconds,the first and second electromagnetic clutches 48,56 are simultaneously deactuated and concurrently with this, the electromagnetic brake 66 is actuated, as shown in FIG. 6, thereby cutting off the rotation of the motor 40 to be transmitted to the second rotary shaft 50 (the motor 40 being normally rotated). It is important to note that when the electromagnetic brake 66 is actuated, the second rotary shaft 50 to which power transmission has been cut off may be instantly stopped. Also, the bevel gears 68,70 are simultaneously stopped, thereby stopping the third rotary shaft 72. However, the spur gear 76 mounted on the third rotary shaft 72 through the one-way roll 74, continues to rotate for a while by virtue of the inertia forces stored during the low-speed rotation in the previous step. Thus, the pair of low-speeding belts 30 in the tubing feeding means 26, being connected to the spur gears 76 through the spur gear 78, are moved slightly by inertia before they make a complete stop. The web 14 formed into the tubing may be stopped after it has been provided with the required tension in the direction of feed on the mandrel 10. An optimum tension may be maintained on the web 14 interposed between the web feeding rolls 24 and the tubing feeding means 26, and during intermittent feeding of web 14, the tubular web will not meander, thereby making it possible to form fine quality packages. Further, since the web feeding rolls 24 and the tubing feeding means 26 are started at low speeds, brought to a steady operation at high speeds and then shifted into a low speed operation before being stopped, a predetermined package length of the web may be fed forward positively, enabling the production of packages at a relatively high rate of operation.

From what has been said, it will be apparent that the invention method offers the possibility of tensioning the web interposed between the web feeding rolls and the tubing feeding means by allowing the tubing feeding means to move slightly further under inertia (that is by stopping the tubing feeding means a little later than the web feeding rolls) when the web feeding rolls are instantly stopped.

Figure 9:
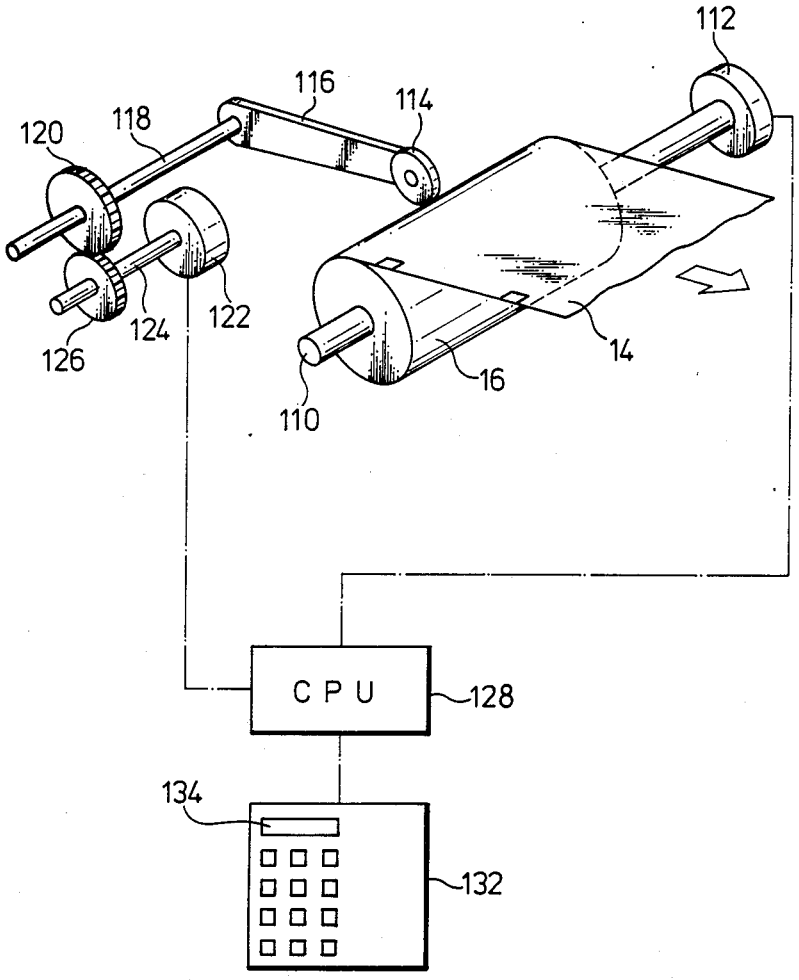
FIGS. 9 and 10 are schematic and symbolic diagrams of an alternative form of the invention.
Figure 10:
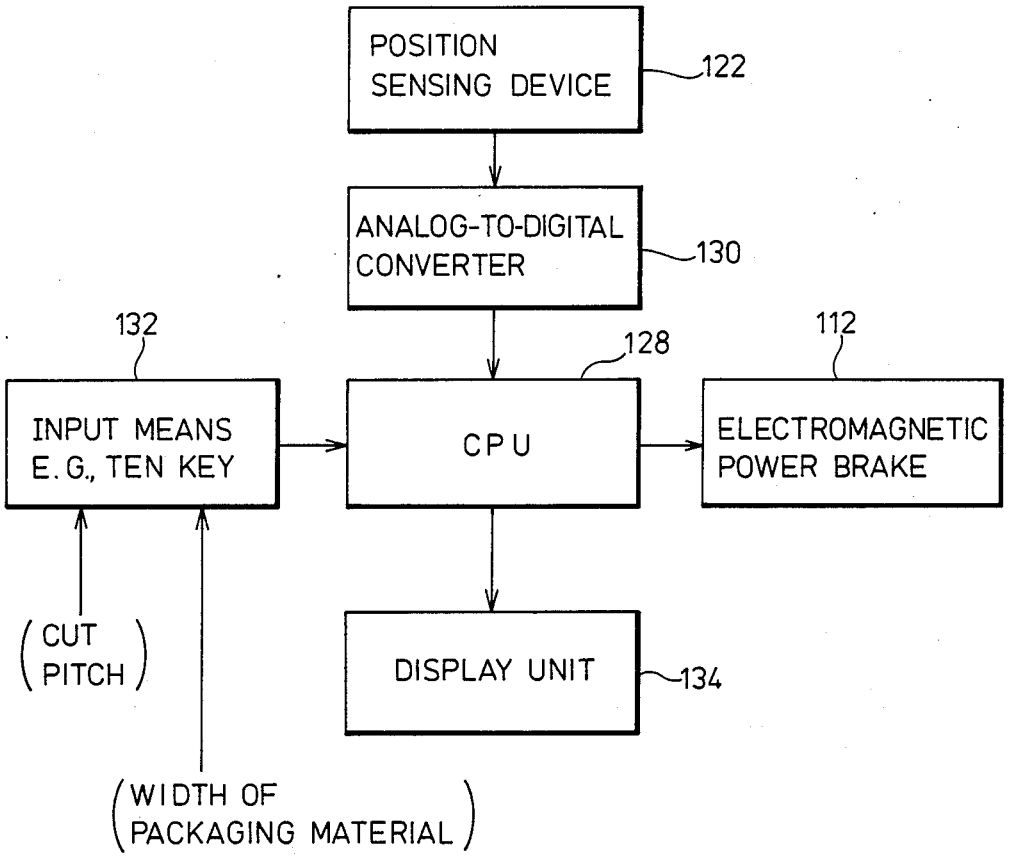

FIGS. 9 and 10 illustrate an alternate method of tensioning a web of material between the supply roll and the web feeding rolls. As may be seen in FIG. 9, the supply roll 16 is supported on a rotary shaft 110 which in turn is rotatably supported by bearings (not shown) to permit free rotation of the supply roll 16. The rotary shaft 110 has connected at one end thereof brake means 112 such as an electromagnetic power brake and a hysterisis brake so that the rotary shaft 110 and hence the supply roll 16 may be suitably braked. Specifically, when the brake means 112 is deactuated, the supply roll 16 may be freely rotated with the rotary shaft 110; and when the brake means 112 is actuated, the feeding rotation of the supply roll 16 may be braked. Thus, the alternate method is directed particularly to that brake force which is tracked and regulated in a so-called real-time manner in proportion to the diameter of the supply roll 16 being diminished with the passage of time.

Contacting the outer periphery of the supply roll 16 is a free roll or rotary wheel 114 pivotally connected to one end of a pivotal lever 116. The other end of the pivotal lever 116 is fixedly connected to one end of a pivotal shaft 118 carried by a bearing (not shown). The other end of the pivotal shaft 118 is connected to a gear 120, which meshes with a gear 126 secured to a rotary shaft 124 of a position sensing device such as a potentiometer 122. Apparently, as the web 14 is pulled from the supply roll 16, the diameter of the roll body is diminished continuously with the passage of time. In this regard, the lever 116, bearing against the supply roll 16 through means of the rotary wheel 114, varies its angular position relative to the pivotal shaft 118. The change in angular position of the lever 116, as a result of the reduction in diameter of the roll body 16, is outputted as an angular change signal through the pair of gears 120,126 and the potentiometer 122.

As shown in FIGS. 9 and 10, the output of the potentiometer 122 is fed to a central processing unit 128 through an analog-to-digital converter 130. In this regard, numerical information such as width and cut pitch of web 14 has previously been stored in the central processing unit 128 through input means 132 such as a ten key pad. The central processing unit 128 compares the signal representative of the angular position sensed by the potentiometer 122, that is the actual reduction in diameter of the supply roll 16, with the data representative of the width and the cut pitch of web 14. Based on this comparison, an instruction signal is processed in and outputted from the central processing unit 128 to give a most appropriate feeding speed which is applicable to the supply roll 16 at that time, the signal being fed back to the brake means 112. It will be noted that the instruction signal values may be digitally displayed on a display unit 134 such as a CRT or a liquid crystal display.

In the operation of the vertical form-fill-seal packaging apparatus, the web feeding rolls 24 pull a package length increment of web 14 from the supply roll 16, thereby diminishing the diameter of the supply roll 16. Unless extra countermeasures are taken, the supply roll 16 will diminish its diameter with the passage of time, thereby reducing its mass. Between the starting and the final stage of the supply roll 16, a significant difference is apparent in the feeding speeds of the supply roll 16, which is rotated by the web 14 being pulled forward intermittently. Because of this difference, the supply roll 16 will excessively overrun, causing slack of the web 14 in the region from the supply roll 16 to the web feeding rolls 24.

To cope with this, in the present method, the reduction in diameter of the supply roll 16 is sensed as an angular change by the means of potentiometer 122 in a real-time manner, the angular change being inputted into the central processing unit 128. The central processing unit 128 has stored therein factors, such as width and cut pitch of the web 14, which will influence the feeding speed of the web 14 and hence, by processing the data, the central processing unit 128 may issue a most suitable instruction signal at that time to brake the supply roll 16. The instruction signal is inputted into the electromagnetic power brake 112 as a control signal to brake the rotary shaft 110 of the supply roll 16. As the braking force increases in inverse proportion to the reduction in diameter of the supply roll 16, a proper tension is always imparted to the web 14 interposed between the supply roll 16 and the web feeding rolls 24. Thus, the present method solves the problem of web slack which will be developed between the supply roll 16 and the web feeding rolls 24, thereby making it possible to feed the web at a higher rate of speed at all times.

Obviously, many modifications and variations of the present invention are possible in light of the above teachings. It is therefore to be understood that within the scope of the appended claims, the present invention may be practiced otherwise than as specifically described herein.

What is claimed is:

1. A method of tensioning a web of packaging material in a form-fill-seal packaging system, wherein the web of packaging material is pulled from a supply roll by means of web feeding rolls, and guided over means for forming the web or packaging material into tubing for enveloping articles to be packaged within the packaging material and for forwarding the formed enveloping tubing toward a sealing means for forming sealed packages, between the web feeding rolls and the tube forming means, comprising the steps of:

providing a single source of driving power for both said web feeding rolls and said tube forming means;

providing a first transmission means upon a shaft, between said single source of driving power and said web feeding rolls, and between said single source of driving power and said tube forming means, for driving said web feeding rolls and said tube forming means at a low rate of speed;

providing a second transmission means upon said shaft, between said single source of driving power and said web feeding rolls, and between said single source of driving power and said tube forming means, for driving said web feeding rolls and said tube forming means at a high rate of speed;

providing a one-way transmission means between both said first and second transmission means and said tube forming means;

actuating said first transmission means while deactuating said second transmission means so as to drive said web feeding rolls and said tube forming means at said low rate of speed so as to initially tension said web of material;

actuating said second transmission means while deactuating said first transmission means so as to drive said web feeding rolls and said tube forming means at said high rate of speed for conveying a predetermined amount of said web or packaging material at a high rate of production speed in preparation for formation of an enveloping package within which one of said article is to be enveloped;

actuating said first transmission means while deactuating said second transmission means so as to drive said web feeding rolls and said tube forming means at said low rate of speed in preparation for stopping of said web feeding rolls and said tube forming means whereupon sealing of said package can occur; and deactuating said first transmission means while maintaining said second transmission means deactuated, and stopping said web feeding rolls and said transmission shaft, so as to stop driving power from being transmitted to said web feeding rolls and said tube forming means yet permitting said one-way transmission means to continue to rotate said tube forming means for a limited time after said stoppage of said web feeding rolls so as to retain said tension upon said web of packaging material within said stopped mode.

2. A method of tensioning a web of material, pulled from a supply roll by means of web feeding rolls and guided over web processing means, between said web feeding rolls and said web processing means, comprising the steps of:

providing a single source of driving power for both said web feeding rolls and said web processing means;

providing a first transmission means upon a shaft, between said single source of driving power and said web feeding rolls, and between said single source of driving power and said web processing means, for driving said web feeding rolls and said web processing means at a low rate of speed;

providing a second transmission means upon said shaft, between said single source of driving power and said web feeding rolls, and between said single source of driving power and said web processing means, for driving said web feeding rolls and said web processing means at a high rate of speed;

providing a one-way transmission means between both said first and second transmission means and said web processing means;

actuating said first transmission means while deactuating said second transmission means so as to drive said web feeding rolls and said web processing means at said low rate of speed so as to initially tension said web of material;

actuating said second transmission means while deactuating said first transmission means so as to drive said web feeding rolls and said web processing means at said high rate of speed for convenying a predetermined amount of said web of material at a high rate of production speed;

actuating said first transmission means while deactuating said second transmission means so as to drive said web feeding rolls and said web processing means at said low rate of speed in preparation for stopping said web feeding rolls and said web processing means; and deactuating said first transmission means while maintaining said second transmission means deactuated, and stopping said web feeding rolls and said transmission shaft, so as to stop driving power from being transmitted to said web feeding rolls and said web processing means yet permitting said one-way transmission means to continue to rotate said web processing means for a limited time after said stoppage of said web feeding rolls so as to retain said tension upon said web of material between said web feeding rolls and said web processing means during said stopped mode.

3. A method of tensioning a web of material, pulled from a supply roll by means of web feeding rolls, between said supply roll and said web feeding rolls, comprising the steps of:

rotating said web feeding rolls for a predetermined amount of time, and at a predetermined rate of speed, so as to unroll said web of material from said supply roll;

sensing the progressive diminishing of the outer diameter of said supply roll as said web of material is unrolled from said supply roll by said web feeding rolls during said predetermined amount of time;

generating signals indicative of said sensed outer diameter values of said progressively diminishing supply roll;

using a central processing unit to compare said sensed outer diameter values of said progressively diminishing supply roll with predetermined volume values previously stored within said central processing unit; and causing said central processing unit to apply braking forces to said supply roll in response to said compared values so as to progressively retard said supply roll as said outer diameter of said supply roll progressively diminishes in order that said web material is withdrawn from said supply roll under a predetermined amount of tension.

4. Apparatus for tensioning a web of packaging material in a form-fill-seal packaging system, comprising:

a supply roll of said packaging material;

tube forming means for forming said packaging material into tubular envelopes within which articles are to be packaged;

web feeding rolls for withdrawing said web of packaging material from said supply roll and forwarding said withdrawn web of packaging material to said tube forming means;

drive means for driving both said tube forming means and said web feeding rolls;

first transmission means, mounted upon transmission shaft means, interposed between said drive means and both said web feeding rolls and said tube forming means for selectively actuating both said web feeding rolls and said tube forming means at a first operative rate of speed;

second transmission means, mounted upon said transmission shaft means, interposed between said drive means and both said web feeding rolls and said tube forming means for selectively actuating both said web feeding rolls and said tube forming means at a second operative rate of speed;

brake means operatively connectible to said web feeding rolls and said transmission shaft means for selectively permitting said web feeding rolls and said transmission shaft means to rotate in a drive mode, or for preventing rotation of said web feeding rolls and said transmission shaft means; and one-way transmission means interposed between said transmission shaft means and said tube forming means for permitting said tube forming means to continue to rotate for a predetermined time after said brake means has stopped rotation of said web feeding rolls and said transmission shaft means so as to cause said tube forming means to retain said web of packaging material, interposed between said web feeding rolls and said tube forming means, in a tensioned state.

5. Apparatus as set forth in claim 4, wherein:

said transmission shaft means includes first and second shafts;

said first transmission means includes a first small gear mounted upon said first transmission shaft and a second larger gear mounted upon said second transmission shaft; and said second transmission means includes a third large gear mounted upon said first transmission shaft, and a fourth smaller gear mounted upon said second transmission shaft.

6. Apparatus as set forth in claim 5, wherein:

said first transmission means includes a first clutch mounted upon said second transmission shaft; and said second transmission means includes a second clutch mounted upon said first transmission shaft.

7. Apparatus as set forth in claim 6, wherein:

said drive means is mounted upon said first transmission shaft; and said one-way transmission means is mounted upon said second transmission shaft.

8. Apparatus as set forth in claim 6, further comprising:

a first timing pulley mounted upon said second transmission shaft; and a second timing pulley mounted upon a shaft operatively connected to said web feeding rolls.

9. Apparatus as set forth in claim 8, wherein:

said braking means is mounted upon said web feeding rolls shaft.

10. Apparatus as set forth in claim 4, wherein:

said transmission shaft means includes first and second shafts;

said first transmission means includes a first small timing pulley mounted upon said first transmission shaft, and a second larger timing pulley mounted upon said second transmission shaft; and said second transmission means includes a third large timing pulley mounted upon said first transmission shaft, and a fourth smaller timing pulley mounted upon said second transmission shaft.

11. Apparatus as set forth in claim 10, wherein:

said first and second transmission means both include clutches mounted upon said second transmission shaft.

12. Apparatus as set forth in claim 4, wherein:

said transmission shaft means includes first and second shafts;

said first transmission means includes a first small sprocket mounted upon said first transmission shaft, and a second larger sprocket mounted upon said second transmission shaft; and said second transmission means includes a third large sprocket mounted upon said first transmission shaft, and a fourth smaller sprocket mounted upon said second transmission shaft.

13. Apparatus as set forth in claim 12, wherein:

said first and second transmission means both include clutches mounted upon said second transmission shaft.

14. Apparatus as set forth in claim 13, wherein:

said drive means comprises a pair of drive motors mounted upon said first transmission shaft.

15. Apparatus for tensioning a web of material, pulled from a supply roll by means of web feeding rolls and guided over web processing means, between said web feeding rolls and said web processing means, comprising:

a supply roll of said web material;

web processing means for using said web material in the fabrication of a product;

web feeding rolls for withdrawing said web material from said supply roll and forwarding said withdrawn web material to said web processing means;

drive means for driving both said web processing means and said web feeding rolls;

first transmission means, mounted upon transmission shaft means, interposed between said drive means and both said web feeding rolls and said web processing means for selectively actuating both said web feeding rolls and said web processing means at a first operative rate of speed;

second transmission means, mounted upon said transmission shaft means, interposed between said drive means and both said web feeding rolls and said web processing means for selectively actuating both said web feeding rolls and said web processing means at a second operative rate of speed;

brake means operatively connectible to said web feeding rolls and said transmission shaft means for selectively permitting said web feeding rolls and said transmission shaft means to rotate in a drive mode, or for preventing rotation of said web feeding rolls and said transmission shaft means; and one-way transmission means interposed between said transmission shaft means and said web processing means for permitting said web processing means to continue to rotate for a predetermined time after said brake means has stopped rotation of said web feeding rolls and said transmission shaft means so as to cause said web processing means to retain said web of material, interposed between said web feeding rolls and said web processing means, in a tensioned state.

16. Apparatus as set forth in claim 15, wherein:

said web of material comprises packaging material within which articles are to be packaged.

17. Apparatus as set forth in claim 16, wherein:

said web processing means comprises tube forming means for forming said packaging material into tubular envelopes within which said articles can be packaged.

18. Apparatus for tensioning a web of material, pulled from a supply roll by means of web feeding rolls, between said supply roll and said web feeding rolls, comprising:

a supply roll of said web material;

web feeding rolls for withdrawing said web material from said supply roll;

senser means for sensing the progressive diminishing of the outer diameter of said supply roll as said web of material is withdrawn from said supply roll by said web feeding rolls;

means operatively connected to said senser means for generating signals indicative of said sensed outer diameter values of said progressively diminishing supply roll;

central processing means operatively connected to said signal generating means for receiving said signals and comparing said sensed supply roll outer diameter value signals with predetermined volume values stored within said central processing means; and braking means operatively connected to said supply roll of said web material for progressively retarding the rotation of said supply roll, in response to signals received from said central processing means, as said outer diameter of said supply roll progressively diminishes in order that said web of material is withdrawn from said supply roll under a predetermined amount of tension.

19. Apparatus as set forth in claim 18, wherein:

said senser means is a feeler in contact with the outer surface of said supply roll of said web material.

20. Apparatus as set forth in claim 18, wherein:

said signal generating means is a potentiometer.

* * * * *